US009658601B2

(12) United States Patent
Karapatis et al.

(10) Patent No.: US 9,658,601 B2
(45) Date of Patent: May 23, 2017

(54) ACOUSTIC RADIATING MEMBRANE FOR A MUSICAL WATCH

(71) Applicant: Montres Breguet S.A., L'Abbaye (CH)

(72) Inventors: Polychronis Nakis Karapatis, Premier (CH); Younes Kadmiri, Morre (FR); Davide Sarchi, Renens (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/527,184

(22) Filed: Oct. 29, 2014

(65) Prior Publication Data

US 2015/0160617 A1 Jun. 11, 2015

(30) Foreign Application Priority Data

Dec. 9, 2013 (EP) ..... 13196237

(51) Int. Cl.

| | |
|---|---|
| ***G04B 21/08*** | (2006.01) |
| ***G04B 37/00*** | (2006.01) |
| ***G04B 23/08*** | (2006.01) |
| ***G10K 9/20*** | (2006.01) |
| *H04R 7/02* | (2006.01) |
| *H04R 7/12* | (2006.01) |

(52) U.S. Cl.

CPC ..... *G04B 37/0075* (2013.01); *G04B 21/08* (2013.01); *G04B 23/08* (2013.01); *G10K 9/20* (2013.01); *H04R 7/02* (2013.01); *H04R 7/127* (2013.01)

(58) Field of Classification Search

CPC .... G04B 37/0075; G04B 21/08; G04B 23/08; G10K 9/20; H04R 7/02; H04R 7/127

USPC ..... 368/260, 125; 381/124

See application file for complete search history.

(56) References Cited

U.S. PATENT DOCUMENTS

| | | | | |
|---|---|---|---|---|
| 3,906,713 | A | 9/1975 | Suda et al. | |
| 4,532,383 | A * | 7/1985 | Willy | G10K 13/00 181/157 |
| 8,233,646 | B2 * | 7/2012 | Lutz | H04R 7/18 381/150 |
| 2007/0140067 | A1 | 6/2007 | Greubel et al. | |
| 2008/0002850 | A1 * | 1/2008 | Watanabe | H04R 7/127 381/412 |

(Continued)

FOREIGN PATENT DOCUMENTS

| | | |
|---|---|---|
| CH | 304 446 | 1/1955 |
| DE | 10 80 029 | 4/1960 |

(Continued)

OTHER PUBLICATIONS

Translation CH 304446—epo.org; Jun. 26, 2015.*

(Continued)

*Primary Examiner* — Sean Kayes

(74) *Attorney, Agent, or Firm* — Oblon, McClelland, Maier & Neustadt, L.L.P.

(57) ABSTRACT

The acoustic radiating membrane is provided to equip a musical watch or a striking watch. The dome-shaped membrane comprises an active central portion, a lateral wall and a peripheral edge portion for holding the membrane in a watch case. The central part is configured in a convex shape or a conical shape and with dimensions devised to amplify a first vibration mode of one or more notes within a frequency range of between 500 Hz and 3.5 kHz.

16 Claims, 4 Drawing Sheets

(56) References Cited

U.S. PATENT DOCUMENTS

| | | | | |
|---|---|---|---|---|
| 2008/0219481 | A1* | 9/2008 | Baeten | H04R 9/043 381/150 |
| 2010/0239109 | A1* | 9/2010 | Lutz | H04R 7/18 381/190 |
| 2012/0140603 | A1 | 6/2012 | Sarchi et al. | |
| 2012/0154924 | A1* | 6/2012 | Lee | G02B 7/028 359/666 |
| 2012/0243389 | A1 | 9/2012 | Sciascia et al. | |
| 2013/0315414 | A1* | 11/2013 | Pribyl | H04R 3/02 381/74 |

FOREIGN PATENT DOCUMENTS

| | | | |
|---|---|---|---|
| EP | 1 795 978 | A2 | 6/2007 |
| EP | 2 461 219 | A1 | 6/2012 |
| EP | 2 503 417 | A1 | 9/2012 |
| FR | 1064970 | | 5/1954 |

OTHER PUBLICATIONS

Translation FR 1064970—epo.org; Jun. 26, 2015.*
European Search Report issued Jul. 22, 2014, in European Application No. 13196237.5 filed Dec. 9, 2013 (with English Translation).

* cited by examiner

ACOUSTIC RADIATING MEMBRANE FOR A MUSICAL WATCH

This application claims the priority from European Patent application No. 13196237.5 filed on Dec. 9, 2013, the entire disclosure of which is hereby incorporated herein by reference.

FIELD OF THE INVENTION

The invention concerns an acoustic radiating membrane for a musical watch, or a striking watch.

BACKGROUND OF THE INVENTION

In the field of watch making, a striking mechanism may be added to a watch movement in order to create a sound or play music. The gong of the striking watch or the vibration plate of the musical watch are generally arranged inside the watch case. Thus, the vibrations of the gong or of the vibration plate tongues are transmitted to the various external parts of the watch. These external parts are, for example, the middle part, the bezel, the crystal and the back cover of the watch case. These large external parts start to radiate sound into the air under the effect of the transmitted vibrations. When a sound is produced either by a gong struck by a hammer, or by one or more vibrating tongues of the vibration plate, these external parts are capable of radiating the produced sound into the air.

Usually, in a striking or musical watch of this type, acoustic efficiency, based on the complex vibro-acoustic transduction of the external parts, is low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

To further improve the vibro-acoustic efficiency of the striking mechanism, a membrane can be arranged inside the watch case. The membrane must be dimensioned so that all the notes created by the vibration of one of more gongs, or of the vibration plate tongues are efficiently radiated. It is therefore important that the frequency of these notes is close to the natural modes of the membrane in order to allow it to enter into resonance.

In is noted in this regard that a high modal density over a limited frequency bandwidth, for example between 500 Hz and 3.5 kHz. is hard to obtain, since this characteristic is only compatible with membranes of very low stiffness or of very high mass. These two characteristics are not beneficial, since reducing the frequency of the first resonant mode to around 1,000 Hz in this manner also reduces the frequency of the excited modes, whose acoustic performance is very limited, below 4,000 Hz. The mechanical energy is therefore dissipated in vibration modes of the membrane having poor acoustic efficiency. The radiation efficiency, which is logically defined as the ratio between the radiated acoustic energy divided by the total energy transferred to the membrane, is therefore reduced over almost the entire frequency range of interest. It is therefore hard to obtain a resonance on every note created by the striking mechanism, which constitutes a drawback of state of the art membranes.

EP Patent Application No. 2 461 219 A1, which discloses an acoustic radiating membrane for a musical or striking watch, may be cited in this regard. This acoustic membrane has a general dome shape with its peripheral edge sandwiched between part of the middle part and the back cover of the watch case. This membrane is designed with one or two asymmetrically shaped areas formed in the material of the membrane. The two areas excavated in the general thickness of the membrane are of different dimensions. These two areas form ellipses, which are offset from each other relative to the centre of the membrane and partly superposed. With these ellipses in the membrane, it is possible to have twice the number of natural modes of vibration for each ellipse in comparison with a circular shape. However, this does make it possible to increase the range of vibration modes of the membrane to obtain a vibratory response amplified over a larger frequency bandwidth, which constitutes a drawback.

SUMMARY OF THE INVENTION

It is therefore an object of the invention to overcome the drawbacks of the aforementioned state of the art, by providing an acoustic radiating membrane for a musical watch or striking watch, created to obtain an amplified response of the membrane over a broader frequency bandwidth.

The invention therefore concerns an acoustic radiating membrane for a musical watch or a striking watch, the membrane including an active central portion and an edge portion for holding the membrane in a watch case, wherein the central portion is configured in a convex shape or a conical shape and having dimensions devised to promote the vibration of the membrane according to a first unipolar deformation mode, following the activation of the membrane by one or more frequencies within the range between 500 Hz and 3.5 kHz.

Particular embodiments of the acoustic membrane are defined in the dependent claims 2 to 22.

An advantage of the acoustic radiating membrane lies in the fact that with a central portion having a convex or conical shape, the amplitude of vibration can be increased particularly over the frequency bandwidth from 500 Hz to 3.5 kHz. With such a complex geometrical shape of the acoustic membrane created in a determined material and of a general thickness defined with in-plane dimensions comparable to the in-plane dimensions of a watch case or crystal, the acoustic response of the membrane is substantially improved relative to a conventional solution throughout the entire interval of frequencies of interest.

Advantageously, it is possible to guarantee the amplification of a set of notes generated in a musical or striking watch. The first vibration mode of each note generated lies therefore at least within the range of frequencies between 500 Hz and 3.5 kHz. In addition, the peak width of the first vibration mode is greater than for a state of the art flat bottom membrane.

Advantageously, the membrane can be created in amorphous metal or in metallic glass, or also in gold or platinum, or even in brass, titanium, aluminium or in another material with a similar density, Young's modulus and elastic limit. With such a membrane, extension of the bandwidth can be combined with very low internal damping, which allows for very good acoustic performance.

BRIEF DESCRIPTION OF THE DRAWINGS

The objects, advantages and features of the acoustic radiating membrane for a musical watch or striking watch will appear more clearly in the following description given on the basis of non-limiting embodiments, illustrated by the drawings, in which.

DETAILED DESCRIPTION OF THE INVENTION

In the following description, reference will be made to the configuration of an acoustic radiating membrane, to equip, in particular, a musical watch, or a striking watch. The acoustic radiating membrane is created in a complex form to increase the vibration amplitude of the different notes generated in a watch case. The membrane is dimensioned so as to amplify, in particular, the first vibration mode in the frequency band from 500 Hz to 3.5 kHz.

Figure 1A:
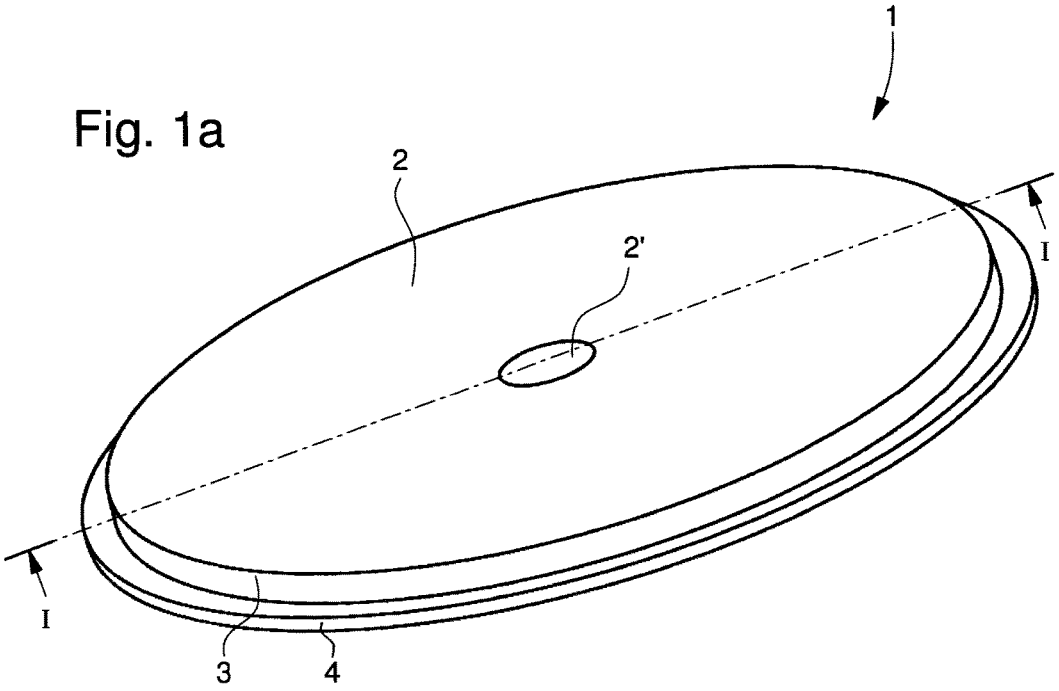
FIGS. 1*a* and 1*b* show a simplified, three-dimensional view and a diametrical cross-section along the line I-I of FIG. 1*a* of a first embodiment of the acoustic radiating membrane according to the invention.
Figure 1B:
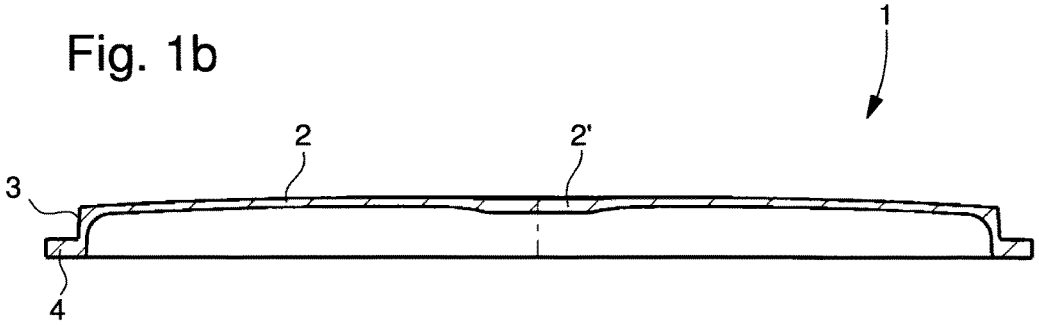

FIGS. 1*a* and 1*b* show a first embodiment of the acoustic radiating membrane 1, which may equip a musical watch or a striking watch. Depending on the shape of the watch case, the acoustic radiating membrane 1 may, when seen from above, have a generally rectangular, or polygonal, or preferably circular shape as shown in FIG. 1*a*.

Membrane 1 is configured, for example, in a dome shape with an active central portion 2, which is generally convex, and a cylindrical lateral wall 3, which terminates with a peripheral edge portion 4. The active central portion 2 is preferably convex towards the exterior of the dome, but may also be convex on the inside of said dome. In this case active central portion 2 forms the bottom of the membrane. Active central portion 2, lateral wall 3 with a peripheral edge portion 4 generally only form one part in the same material, which may be metallic.

It is to be noted that instead of a peripheral edge portion, an edge portion in the form of several peripheral sections distributed over the periphery of lateral wall 3 may be provided to hold the membrane inside a watch case.

The acoustic radiating membrane 1 may be formed in one-piece in a material, which may be amorphous metal or metallic glass in the example described with reference to FIGS. 3 and 4 explained hereafter. However, this membrane can be created in another material, such as gold, or platinum, or even brass, titanium, aluminium for example with a similar density, Young's modulus and elastic limit.

Preferably, the convex central portion 2 further comprises a mass 2' added to the centre of the convex central portion. This mass 2' may be an additional part fixed to the active central portion or preferably be integral with active central portion 2 and simply define a thickened section of the material close to the centre of membrane 1. This mass 2' added to central portion 2 allows for a reduction in the first natural frequency of the radiating note without thereby reducing the stiffness of said membrane.

In another embodiment, the membrane may be made in two materials M1 and M2, which have different mechanical properties. The added mass may in particular be created in the material M2, whilst the rest of the membrane is made from material M1. It can also be envisaged, that the convex or conical central portion be made by depositing a material M2 on a membrane made from a different material M1.

The acoustic membrane 1 can be mounted in a watch case (not shown) with its peripheral edge portion 4, which is clamped in a conventional manner between the back cover and the middle part of the watch case with a sealing gasket. After mounting the membrane in the watch case, the convex central portion is not in contact with the other parts of the watch and is therefore free to vibrate in its fundamental mode of vibration. It has a unipolar spatial shape and therefore great acoustic efficiency. Central portion 2 is arranged in proximity to the back cover of the watch case but without contact. According to FIGS. 1*a* and 1*b*, which show bottom views of the membrane, central portion 2 is generally convex on the back cover side of the watch case.

Convex central portion 2 may, from its connection to lateral wall 3, have a diameter of more than 15 mm and preferably between 20 and 40 mm. This diameter may be substantially equivalent to that of the watch crystal (not shown), given that peripheral edge portion 4 may be clamped between a peripheral support member on the back cover of the watch case and a circular internal rim on the middle part. The thickness of central portion 2 may be identical everywhere with the exception of the location of additional mass 2'. This thickness may be more than 50 μm and preferably less than 1 mm, whilst the thickness of thickened portion 2' of the central portion may, for example, be twice the thickness of the surrounding central portion. Thickened portion 2' may be circular, when seen from above, with a diameter of more than 1.5 mm and preferably between 2 and 4 mm, and extend towards the centre of the dome.

Convex central portion 2 is therefore dimensioned according to the materials of which it is composed in order to amplify vibration over the frequency bandwidth from 500 Hz to 3.5 kHz. The acoustic response of the membrane is therefore substantially improved in this frequency bandwidth. As the membrane is mounted in a striking or musical watch, the first mode of vibration of each note generated lies therefore at least within the range of frequencies from 500 Hz to 3.5 kHz.

It should be noted that the thickness of central portion 2 of membrane 1 may be variable. The thickness may, for example, be greater at the centre of the central portion independently of additional mass 2' and decreases progressively, for example in a linear manner, up to the periphery of central portion 2. It may also be provided that this thickness varies in steps from the centre to the periphery of central portion 2. Other variations in thickness in this central portion may be envisaged in order to ensure amplification of the first vibration mode of notes generated within the frequency range of 500 Hz to 3.5 kHz.

As shown in FIGS. 1*a* and 1*b*, convex central portion 2 may be a spherical cap. This spherical cap may be defined according to the following formula:

$$r/h=\sin(\alpha)/(1-\cos(\alpha))$$

where r represents half the diameter of the central portion, h represents the height from the connection between the lateral wall and the central portion and up to the centre of the central portion, and α represents the angle from the centre of the sphere of the spherical cap between the centre of the central portion to the connection between the lateral wall and the central portion.

For the first embodiment of membrane 1 shown in FIGS. 1*a* and 1*b*, the angle α may be between 3° and 8°, preferably between 4° and 5°. For a diameter of 15 mm, the height h of the spherical cap may be around 0.3 mm, whilst for a diameter of 40 mm, the height h of the spherical cap may be around 0.8 mm. The radius of the spherical cap may be defined to be N times higher, in particular between 6 and 8 times higher than the diameter of the central portion.

It is also to be noted that convex central portion 2 may be of an oval shape or be composed of several convex portions that overlap or are spaced apart from each other.

Figure 2A:
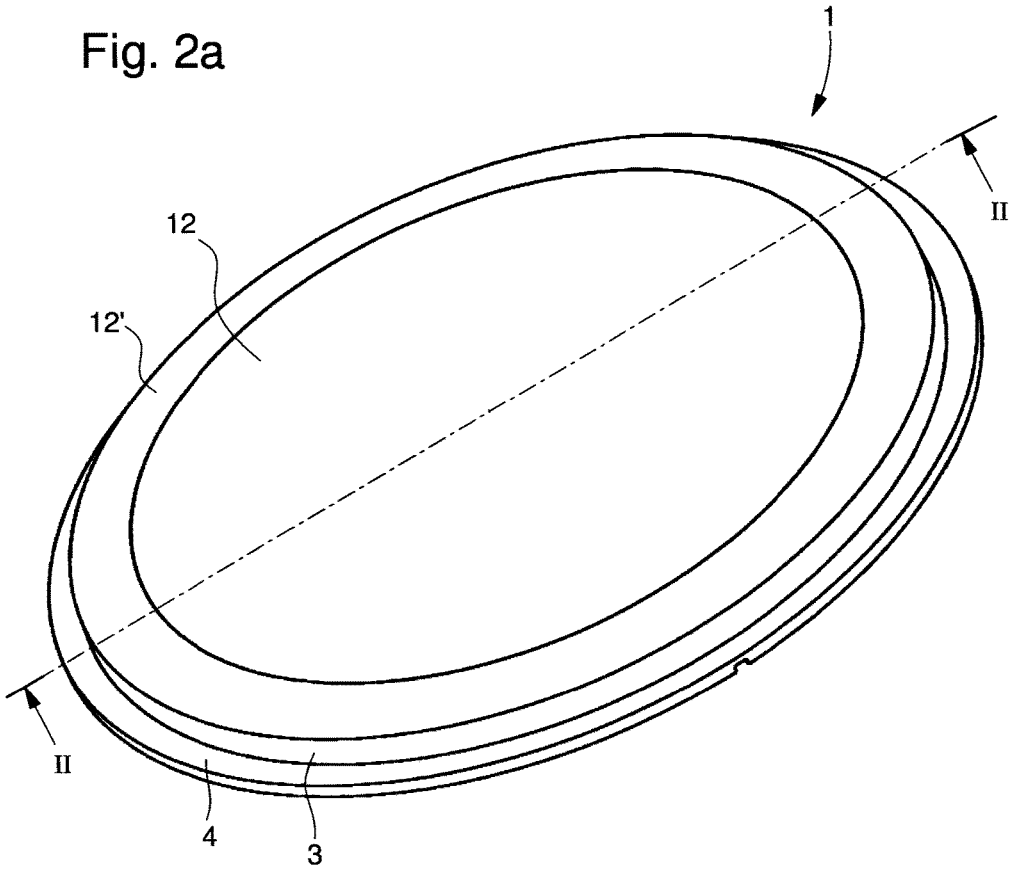
FIGS. 2*a* and 2*b* show a simplified, three-dimensional view and a diametrical cross-section along the line II-II of FIG. 2*a* of a second embodiment of the acoustic radiating membrane according to the invention.
Figure 2B:
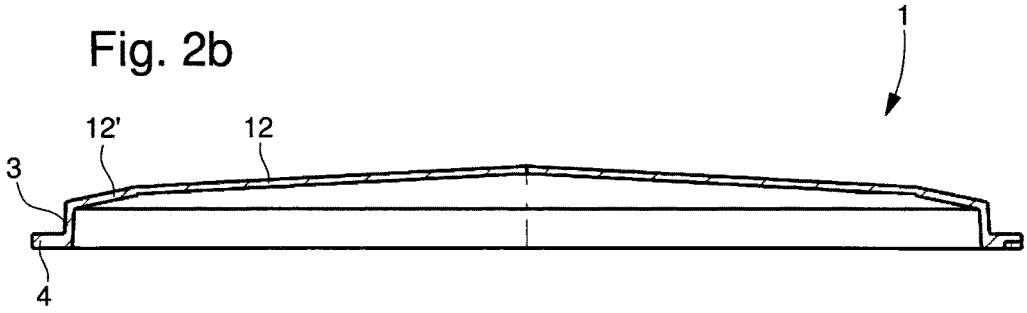

FIGS. 2*a* and 2*b* show a second embodiment of acoustic radiating membrane 1, which may equip a musical watch or a striking watch. Depending on the shape of the watch case, acoustic radiating membrane 1 may, when seen from above, be of a generally rectangular, or polygonal or preferably circular shape, as shown in FIG. 2*a* as defined for the first embodiment. The dimensions and the material used to create membrane 1 of the second embodiment are similar to those defined for the first embodiment. For reasons of simplification, the description of the dimensions and materials will not be repeated.

The essential difference of this second embodiment is that central portion 12 of acoustic radiating membrane 1 is of a generally conical shape. This conical shape preferably extends towards the exterior of the dome-shaped membrane, which comprises a further lateral wall 3 and peripheral edge portion 4 for holding the membrane in the watch case.

The central portion may preferably be composed of two conical portions 12, 12', which are concentric and connected to each other. The first conical portion 12 starts from the centre of membrane 1 and is configured with a first opening angle in relation to the central axis of the membrane. The second conical portion 12' starts from the periphery of first portion 12 and ends at lateral wall 3 with a second opening angle that is different from the first opening angle. Preferably, the second opening angle is smaller than the first opening angle. By way of non-limiting example, the first opening angle may be around 86°, whilst the second opening angle may be around 79°.

The edge portion 4 with lateral wall 3 are integral with the two conical portions 12, 12' to form a single piece. The thickness of each conical portion 12, 12' may be identical at every point. However, it may also be that this thickness decreases linearly from the centre to the periphery of the membrane. This thickness may be greater than 50 μm and preferably less than 1 mm. The diameter of first conical portion 12 may be comprised between 80% and 90%, preferably close to 85% of the diameter of the whole central portion. For the central portion with a diameter of 15 mm, the diameter of first conical portion 12 may be around 12.5 mm, whilst for a central portion with a diameter of 40 mm, the diameter of first conical portion 12 may be around 33 mm. However, the dimensions of the first and second conical portions 12, 12' may be different from those mentioned above and with a second opening angle, which may also be greater than the first opening angle.

The creation of an acoustic radiating membrane with a central portion of a convex or conical shape, makes it possible for the acoustically efficient unipolar fundamental mode of vibration to differ significantly, by a factor of more than 2, from all the other excited vibration modes. These other vibration modes have multipolar deformation and are acoustically inefficient. The advantage is that, according to this construction, the membrane vibrates according to a monopolar deformation even in the presence of a significant frequency deviation between the activation frequency and the resonance frequency of the fundamental mode.

Figure 3:
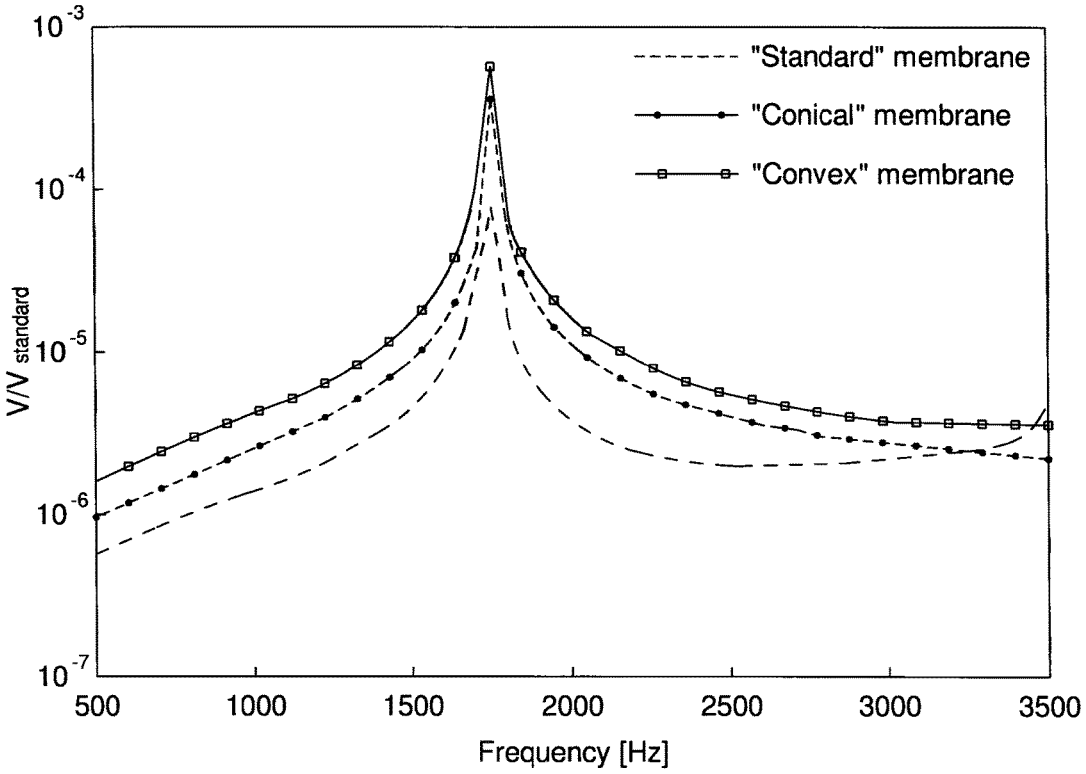
FIG. 3 shows a graph of the integrated frequency response, over the entire volume of the membrane, of the amplitude of velocity normal to the membrane for a standard membrane in metallic glass, a metallic glass membrane according to the first embodiment and a metallic glass membrane according to the second embodiment according to the invention.
Figure 4:
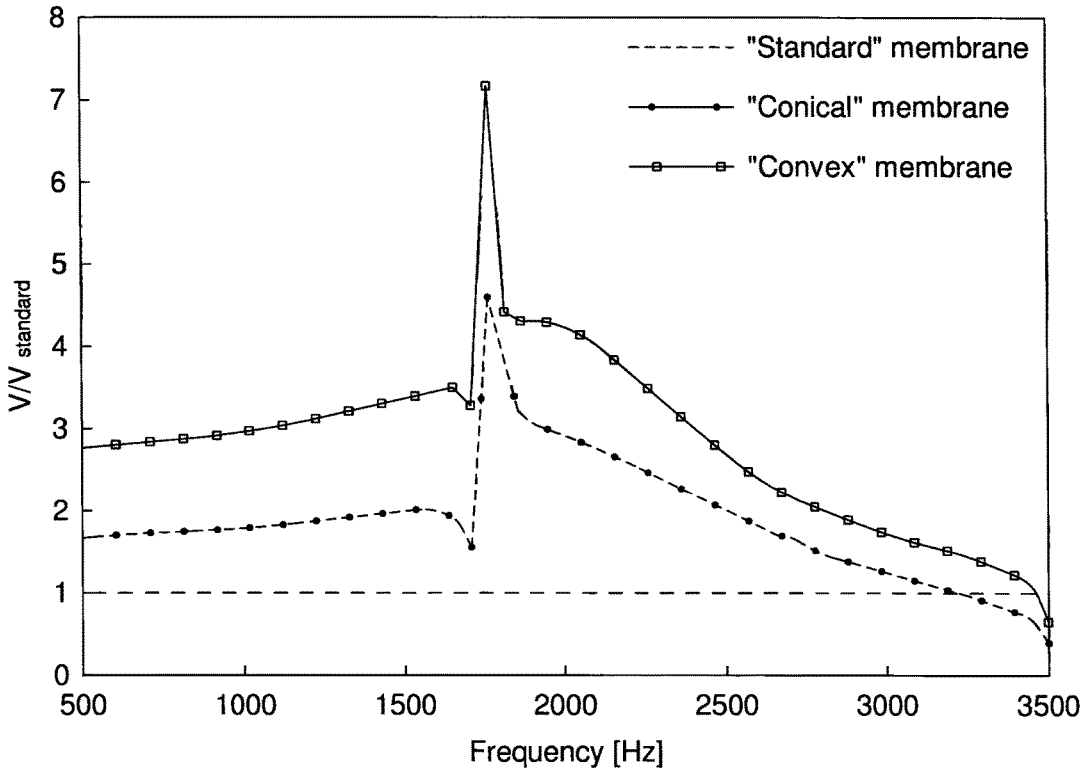
FIG. 4 shows a graph of the ratio between the frequency responses of the membranes of the first and second embodiments according to the invention and of a standard membrane.

Reference can be made to FIGS. 3 and 4 which clearly illustrate this advantage. FIG. 3 shows a graph of the integrated frequency response, over the entire volume of the membrane, of the amplitude of velocity normal to the membrane. This quantity is mathematically defined as $R(f)=\int_{Vol}|v_z(x, y, z, f)|\,dx\,dy\,dz$ for a standard metallic glass membrane, a metallic glass membrane according to the first embodiment and a metallic glass membrane according to the second embodiment according to the invention. FIG. 4 shows a graph of the ratio between the frequency responses of the membranes of the first and second embodiments according to the invention and of a standard membrane.

With regard to the graphs shown in FIGS. 3 and 4, it is noted that the width of the peak of the first vibration mode between 1.5 kHz and 2 kHz, for example at 1.75 kHz, is greater and of larger amplitude than for a peak of the first vibration mode of a standard membrane. Further, the vibrational response is increased below and above the resonance frequency. On the one hand, the first excited vibration mode of the membrane according to the invention is at a substantially higher frequency than the frequency of the first excited mode of the standard membrane. This antiresonance phenomenon, which occurs with activation frequencies comprised between the fundamental mode and the first excited mode of the membrane, is greatly reduced. On the other hand, due to its quasi uniform modal deformation, the fundamental mode is more easily activated, even in an inertial activation regime, at low frequencies. This makes it possible to improve the response below the resonance frequency. In this manner, the membrane is set in vibration according to the spatial deformation of its fundamental mode even in the presence of a relatively large frequency deviation.

Such an acoustic radiating membrane, created with an active central portion of complex shape, in particular a convex or conical shape, therefore makes it possible to increase the vibration amplitude in a frequency range of between 500 Hz and 3.5 kHz. This advantageously differs from a standard membrane whose the central portion is flat.

From the description that has just been given, several variants of the acoustic radiating membrane for a musical watch or striking watch can be devised by those skilled in the art without departing from the scope of the invention defined by the claims. The mass added to the central portion of the membrane may be placed in a different area than the centre of the membrane and several masses may also be added. It may also be envisaged that the mass added to the central portion is created in a material M2 different from the material M1, in which the other parts of the membrane are created.

What is claimed is:

1. An acoustic radiating membrane for a musical watch or a striking watch, the membrane comprising:

an active central portion and an edge portion, the active central portion extending inward from the edge portion where the membrane is held in a watch case, wherein the central portion is configured in a convex shape to promote vibration of the membrane according to a first unipolar deformation mode, following activation of the membrane by one or more frequencies within a range between 500 Hz and 3.5 kHz, wherein the convex central portion is a spherical cap for the membrane of a generally circular shape, wherein the spherical cap is part of a sphere of a radius N times greater than a diameter of the central portion, and wherein the radius of the spherical cap is between 6 and 8 times greater than the diameter of the central portion.

2. The membrane according to claim 1, the membrane having a general dome shape with a central portion defining a base and attached to a lateral wall, and a peripheral edge portion from the lateral wall, wherein the lateral wall is cylindrical.

3. The membrane according to claim 1, wherein the central portion comprises an added mass, which is a part fixed to the central portion or thickened portion of the central portion.

4. The membrane according to claim 3, the membrane having a general dome shape with the central portion defining a base and connected to a lateral wall, and a peripheral edge portion from the lateral wall, wherein the central portion with the added mass, the lateral wall and the peripheral edge portion form a single piece created in the same metallic material.

5. The membrane according to claim 3, wherein the added mass is manufactured in a material M2 different from a material M1, in which the other parts of the membrane are manufactured.

6. The membrane according to claim 1, wherein the thickness of the central portion is identical from the centre to the periphery of the central portion.

7. The membrane according to claim 1, wherein the thickness of the central portion decreases substantially linearly from the centre to the periphery of the central portion.

8. The membrane according to claim 1, wherein the convex portion is obtained by depositing a material M2 different from a material M1, in which the other parts of the membrane are manufactured.

9. An acoustic radiating membrane for a musical watch or a striking watch, the membrane comprising:

an active central portion and an edge portion for holding the membrane in a watch case, wherein the central portion includes two concentric conical portions that are directly connected to one another, a first conical portion that is conical from a centre of the membrane to a peripheral edge of the first conical portion and is configured with a first opening angle in relation to a central axis of the membrane, and a second conical portion that is conical from the peripheral edge of the first conical portion to the edge portion of the membrane and is configured with a second opening angle that is different from the first opening angle, wherein the central portion is configured in a conical shape between the edge portion and the centre of the membrane to promote the vibration of the membrane according to a first unipolar deformation mode, following activation of the membrane by one or more frequencies within a range between 500 Hz and 3.5 kHz, and wherein the central portion is obtained by depositing a material M2 different from a material M1, in which the other parts of the membrane are manufactured.

10. The membrane according to claim 9, the membrane having a general dome shape with a central portion defining a base and connected to a lateral wall, and a peripheral edge portion from the lateral wall, wherein the second conical portion is connected to the first conical portion and the lateral wall.

11. The membrane according to claim 10, wherein the first and second conical portions extend towards the exterior of the membrane in a dome shape.

12. The membrane according to claim 9, wherein the first opening angle of the first conical portion is larger than the second opening angle of the second conical portion.

13. The membrane according to claim 9, wherein the diameter of the first conical portion is between 80% and 90% of the diameter of the whole central portion.

14. The membrane according to claim 9, wherein the thickness of the first and second conical portions is uniform.

15. The membrane according to claim 9, wherein the thickness of the first and second conical portions decrease linearly from the centre to a periphery of the membrane.

16. An acoustic radiating membrane for a musical watch or a striking watch, the membrane comprising:

an active central portion and an edge portion for holding the membrane in a watch case, wherein the central portion is configured in a conical shape between the edge portion and the centre of the membrane to promote the vibration of the membrane according to a first unipolar deformation mode, following activation of the membrane by one or more frequencies within a range between 500 Hz and 3.5 kHz, and wherein the central portion is obtained by depositing a material M2 different from a material M1, in which the other parts of the membrane are manufactured.

* * * * *